United States Patent [19]

Nelson et al.

[11] 4,060,161

[45] Nov. 29, 1977

[54] VIBRATION DAMPENING MEANS FOR PRINTING MECHANISM

[75] Inventors: Carl R. Nelson, Derby; David R. Pierce; Noel F. Depew, both of Wichita; Marlyn F. Harp, Winfield, all of Kans.

[73] Assignee: NCR Corporation, Dayton, Ohio

[21] Appl. No.: 758,521

[22] Filed: Jan. 11, 1977

[51] Int. Cl.[2] ..... B41J 3/04

[52] U.S. Cl. ..... 197/1 R; 101/93.05

[58] Field of Search ..... 197/1 R; 335/274–276, 335/258; 101/93.05

[56] References Cited

U.S. PATENT DOCUMENTS

| | | | |
|---|---|---|---|
| 3,690,431 | 9/1972 | Howard | 197/1 R |
| 3,889,793 | 6/1975 | Cattaned | 197/1 R |
| 3,929,214 | 12/1975 | Hebert | 197/1 R |
| 3,940,726 | 2/1976 | Gershnow | 335/274 |
| 3,985,216 | 10/1976 | McIntosh | 197/1 R |

*Primary Examiner*—Ralph T. Rader

*Attorney, Agent, or Firm*—J. T. Cavender; Albert L. Sessler, Jr.

[57] ABSTRACT

In a matrix print head, a plurality of elongated printing elements, mounted in a frame, are driven axially by electromagnetic means to effect printing on record media positioned adjacent to the printing ends of the printing elements. Freely riding tubular elements are placed on the printing elements between support members forming part of the frame, in order to dampen the bending and vibration of the printing elements, and thus reduce or eliminate consequent fatigue failure.

11 Claims, 4 Drawing Figures

VIBRATION DAMPENING MEANS FOR PRINTING MECHANISM

BACKGROUND OF THE INVENTION

In the field of high-speed printing devices which are especially suitable for use in connection with electronic data processing systems, the wire matrix type of printer has come into increasing use. In this type of printer, letters, numbers and symbols are formed from a series of dots produced by the impact of the ends of a plurality of wire elements on record media, most customarily in combination with an ink ribbon which provides the ink needed to produce a mark on the record medium being printed upon.

One problem which has arisen in connection with use of printers of the wire matrix type is that of fatigue breakage of the print wires and associated springs employed to return the wire to a non-printing position after a printing stroke. This breakage results from bending and vibration of the print wires caused by the high force employed to drive the wires over a short distance to impact upon the record medium being printed upon or the ink ribbon associated therewith. In order to reduce or eliminate such breakage, in some prior art structures, the individual print wires have been confined within tubes or coil springs anchored in the printer framework. However such structures have the disadvantages of increasing the parts and labor costs, and also tend to impede the movement of the printer wires by frictional engagement between the wires and the tubes. This, in turn, has led in some instances to further structural alterations of the printers to provide means for lubricating the wires within the tubes, thereby additionally increasing the cost and complexity of the assembly.

SUMMARY OF THE INVENTION

This invention relates to a printer of the matrix type, and more particularly relates to such a printer which includes means for dampening vibration and bending of the print elements to reduce or eliminate fatigue failure.

In accordance with one embodiment of the invention, a printing mechanism comprises frame means including at least two support members; at least one elongated printing element extending through and supported by said support members and capable of being driven in an axial direction to effect printing; driving means operatively connected to said printing element for axially driving said element; and at least one tubular element having a length less than the distance between adjacent support members, and being unattached to said support members and riding freely on said printing element to dampen undesired transverse movement and vibration thereof.

One advantage of the present invention is that dampening of the bending and vibration of the print elements is achieved without substantial frictional drag on the print elements which might be experienced if a guide tube fixedly secured to frame members of the printer were employed for each print element.

Another advantage of the present invention is that dampening means for the print elements are provided which are inexpensive both in terms of the cost of the parts and in terms of the cost of assembly.

It is accordingly an object of the present invention to provide a print head including elongated printing elements having vibration dampening means for the printing elements which are both inexpensive and effective in operation.

Another object is to provide a print head having elongated printing elements and also having vibration dampening means which do not impose a substantial frictional load on the print elements.

A further object is to provide a print head which is durable and reliable in operation.

With these and other objects, which will become apparent from the following description, in view, the invention includes certain novel features of construction and combinations of parts, one form or embodiment of which is hereinafter described with reference to the drawings which accompany and form a part of this specification.

DESCRIPTION OF THE PREFERRED EMBODIMENT

Figure 1:
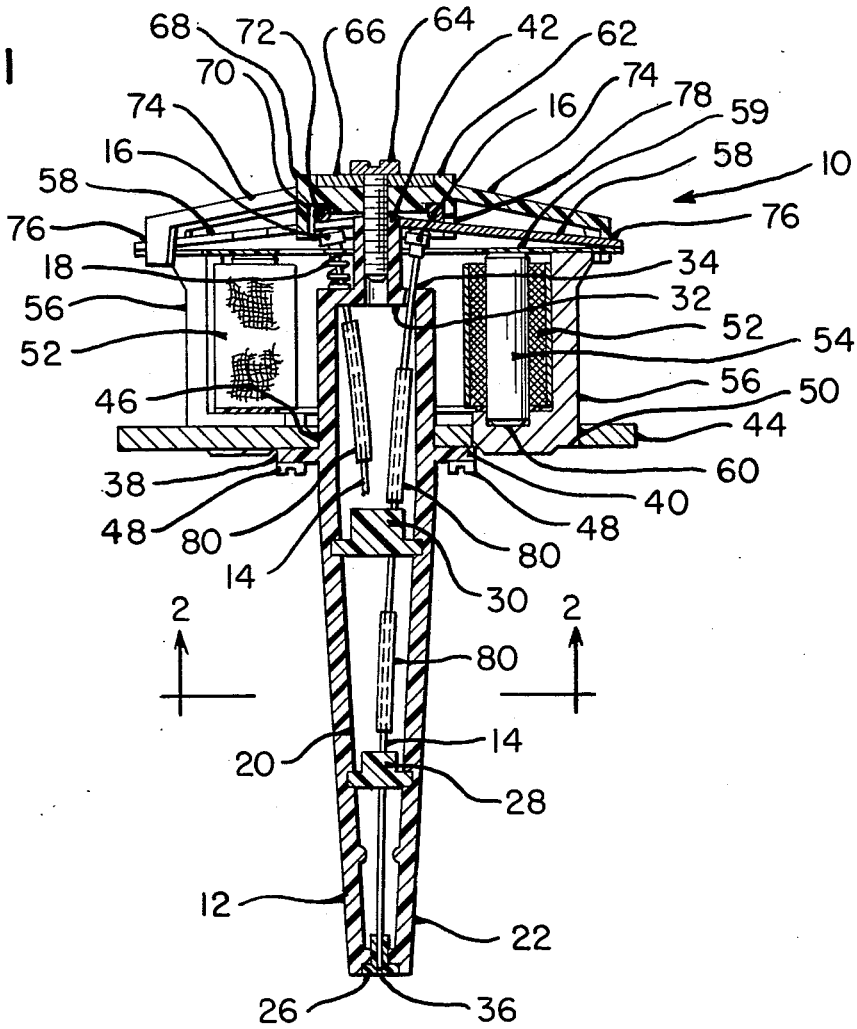
FIG. 1 is a sectional view, taken along line 1—1 of FIG. 2, of a print head in accordance with the present invention.
Figure 2:
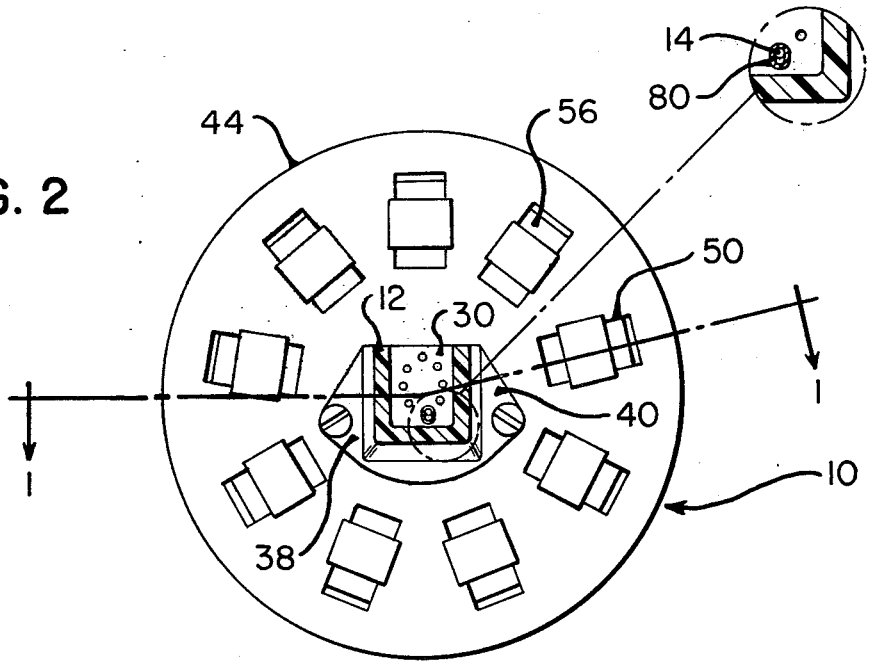
FIG. 2 is a cross-sectional view, taken along line 2—2 of FIG. 1.

Referring now particularly to FIGS. 1 and 2 of the drawings, a print head 10 of the wire matrix type is shown. This print head is similar in general configuration to the print head disclosed in U.S. Pat. No. 3,929,214, issued Dec. 30, 1975, to which reference may be had for a more detailed description of certain aspects of the print head structure.

Figure 3:
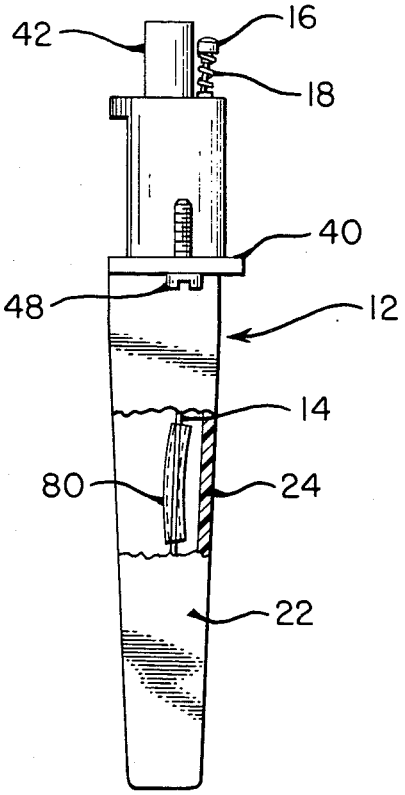
FIG. 3 is an elevation view, partly broken away, showing the frame, the elongated printing elements, and the dampening means, of the print head.

A frame 12 is provided to support a plurality of elongated print elements or print wires 14, only two of which are shown, for purposes of simplification and ready understanding of the drawings. Each wire 14 has a cap 16, which may be made of plastic or other suitable material, attached to its impact-receiving end to enlarge the area of the impact-receiving surface. Each wire 14 also has a spring 18 disposed at its upper end, which exerts an upward force upon the cap 16 to resiliently bias the wire upwardly, as shown in FIGS. 1 and 3, relative to the frame 12. The spring 18 has been omitted from one of the wires of FIG. 1, in order that the cap 16 may be more clearly depicted.

Figure 4:
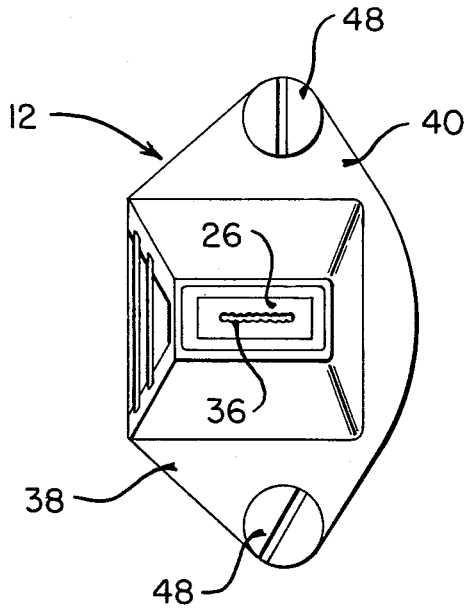
FIG. 4 is an enlarged bottom view of the frame of FIG. 3, showing the printing end of the print head.

The frame 12 includes three side walls 20, 22, and 24, a print end support member 26, two intermediate support members 28 and 30 positioned in grooves in the side walls 20 and 22, and an upper end support member 32 which is formed integral with the side walls 20, 22 and 24 of the frame 12. The members 26, 28, 30, and 32 constrain the various print wires 14 in predetermined paths, and accomplish the translation of the wires from a circular formation at the upper end as seen in FIG. 1 to a linear formation at the printing end. The translation is accomplished by passing each wire 14 through a separate hole 34 in the upper member 32, through similar holes in the members 24 and 22, and into a defined position within a bearing 36 in the print end support member 26, as shown in FIG. 4. The bearing 36 is of a material which resists wear, has a low co-efficient of friction, and has a low co-efficient of thermal expansion.

A pair of mounting flanges 38 and 40 extend laterally from the upper ends of side walls 20 and 22. The frame 12 is circular in cross-sectional shape above the flanges 38, 40 as seen in FIG. 1, and terminates in the upper end support member 32, which is of circular configuration. An apertured post 42 extends from the member 32 and provides means for assembling the driving means for the wires 14 to the frame 12, as will subsequently be described in greater detail.

As shown in FIGS. 1 and 2, a plate 44 is provided with a central aperture 46 and is secured to the flanges 38, 40 on the frame 12 by suitable fastening means 48. The circular portion of the frame 12 extends through the aperture 46. A plurality of holes 50 are provided in the plate 44 for mounting a corresponding plurality, nine in the illustrated embodiment, of actuating means for the wire printing elements 14.

A coil 52, a center pole 54, an "L" shaped outer pole 56 and an armature 58 form the electromagnetic actuating means used in the print head. An armature shim 59 spaces the armatures 58 away from the poles 54 for the purposes of effecting faster armature release. A bore 60 is provided in the horizontal leg of the "L" shaped outer pole 56 for receiving in forced-fit relationship the lower extremity of the center pole 54.

A unitary connector 62 is mounted by means of a screw 64 and a washer 66 to the post 42 of the frame 12. The connector 62 has a circular central portion 68 with an annular groove 70 provided in its bottom surface. An O-ring 72 is inserted in the groove 70 to act as a shock absorber and to provide a reference surface for the cap 16 of the print wire 14 striking the end of the armature 58. Nine arms 74 are formed integral with the central portion 68 of the connector 62 and extend therefrom. Each arm 74 has associated with it a first armature receiving structure 76 and a second armature receiving structure 78. One end of each armature 58 is received and held in place by the structure 76 and the other end of each armature is received and guided by the structure 78. With the connector 62 installed in the position shown, the arms 74 apply forces to the cantilevered distal ends of the armatures, causing their print wire impacting ends to rotate about the fulcrum formed by the top edge of the pole 56 and upwardly into engagement with the O-ring 72. The caps 16 associated with the print wires 14 are maintained in contact with the ends of the armature 58 by means of the forces applied by the springs 18.

As discussed in greater detail in the previously-cited U.S. Pat. No. 3,929,214, the unitary connector 62 serves a number of functions in the assembly and operation of the print head 10, including retaining the armatures 58 in proper relationship to the remainder of the structure, acting as a biasing means for the armatures, providing means for adjusting the air gap between the armatures 58 and corresponding center poles 52, forming a reference surface for the armatures 58 and print wire caps 16, to assure that all actuated print wires 14 impact the record medium at substantially the same time during a printing cycle, and, by means of the O-ring 72, absorbing energy from the armatures 58 and the print wires 14 on return motion after actuation.

As is also described in greater detail in the previously-mentioned U.S. Pat. No. 3,929,214, characters such as numbers, letters or symbols are generated by the print head by a sequence of print cycles. Selective actuation of predetermined combinations of print wires 14 through energization of their corresponding coils 52 during each cycle results in the formation of the desired character on the record medium, with the print head being shifted one position with respect to the record medium after each cycle to be properly located for the next printing cycle.

When a coil 52 is energized, a magnetic flux is created which causes armature 58 to be drawn into contact with center pole 54. The movement of armature 58 transmits energy into print wire 14, causing it to move in an axial direction in the frame 12. The force imparted into the wire 14 causes it to move against the spring 18 and its inertia causes it to continue to move downwardly out of contact with the armature 58 after said armature bottoms out against the center pole 54. The impact-delivering end of the print wire 14 extends beyond bearing 36 and strikes the record medium, causing a dot to be imprinted. The energy stored in the moving print wire 14 is partially absorbed by the impacted record medium and partially returned to the print wire 14, aiding the spring 18 in returning the print wire 14 to its rest position.

At approximately the same time that the print wire 14 is impacting the record medium, the coil 52 is deenergized. The moment exerted on the armature 58 by the arm 74 causes it to rotate away from the center pole 54 and to return into contact with the O-ring 72.

The structure which has been described to this point is conventional and provides an operable print head of the wire matrix type. However extended use of print heads of this type has resulted in problems of breakage of print wires 14 and springs 18 by fatigue failure.

The print wires 14 are small in diameter in order to produce proper character line width, a typical diameter being 0.014 inches. Print wire length is relatively long (typically three inches), in order to enable the print wires to be fanned out from their tight linear pattern at the bearing 36 to the larger circular pattern required to coact with the armatures 58. Due to the large ratio of wire length to wire diameter, and the fact that a relatively large impact force (approximately 4.5 pounds) is required to print, the wire 14 has a tendency to buckle. This tendency can be reduced by the addition of transverse supporting members along the length of the wire. As has been previously noted, some matrix print heads also employ anchored tubes or coil springs as supports, in order to further reduce the likelihood of buckling of the print wire.

In the present structure, a series of simple supports 28, 30 and 32 are spaced at intervals along the wire. However wire buckle still tends to take place between the supports. At the usual rapid actuation rate (typically 650 actuations per second), the buckling rate produces vibration. Over a typical matrix print head life of 75 million characters at an average of 2.2 dots per wire for each character, the print wire will be actuated 165 million times. This is well beyond the typical number of stress cycles for most structural members undergoing fatigue loads.

Wire failure due to vibration fatigue loads is dependent upon the stress induced in the wire. If the stress is low (below the fatigue limit) the wire will last an indefinite number of stress cycles. If the stress is high (above the fatigue limit) the wire will fail in a finite number of cycles. The stress is directly proportional to the radius of curvature (the bow in the wire during vibration). A smaller radius of curvature produces a tighter bow and higher stress.

To reduce wire breakage, the stress incurred during vibration must be lowered. This means increasing the radius of curvature by reducing the distance the wires move radially during vibration. The present invention reduces wire radial motion by adding dampening tubes, such as the tubes 80 shown in FIGS. 1, 2 and 3, to the wire 14 between the fixed supports, such as the supports 28, 30 and 32.

The tubes 80 fit loosely upon the wires 14 and are free to move radially with respect to the print wires as well as moving axially with the print wire as it is actuated, between the adjacent support members, such as between the support members 28 and 30, and between the support members 30 and 32. A tubular member may be placed on each wire between each set of support members, as appropriate.

It will be noted in FIG. 1 that no tube is shown between the end member 26 and the first support member 28. This is because in this portion of the frame of the illustrated embodiment, the wires are spaced quite close to one another, so that the tubes would not fit readily therein. Also the bearing 36 of the end member 26 extends upwardly into the space between the side walls 20, 22, as shown in FIG. 1, thus reducing the unsupported distance between support members of the wires 14.

Since the range of axial freedom of the movement of the tube 80 on the wire 14 is much longer than the wire activating motion initiated by the coil 52 and the armature 58, most drag friction is eliminated between the wire 14 and the tubes 80. It has been found that the dampening tubes 80 effectively reduce wire radial motion well below the point which induces critical stress that leads to fatigue failure.

The tubes 80 may be of any suitable material, either flexible or rigid. Two materials which have been successfully used in actual tests of the device are polytetrafluoroethylene resin and fluorocarbon resin.

Typical dimensions of the tubular members 80 which have been found to be suitable for use in connection with a print wire having a diameter of 0.014 inches and a length of 3 inches are a length of 0.50 inches plus or minus 0.040 inch tolerance, an inside diameter of 0.027 inches with a tolerance of plus or minus 0.007 inches, an outside diameter of 0.051 inches with a tolerance of plus or minus 0.004 inches. The tube may be of circular cross-sectional configuration, or may alternatively be of an oval configuration, as shown in FIG. 2.

A mass ratio which has been found to be successful is approximately 17 to 1; that is, the mass of the tubular element positioned on a wire 14 is approximately 17 times the mass of the wire 14 between adjacent support members. However this is not critical, and a wide range of mass ratios may be used.

In one length ratio which has been found to be successful, the length of the tubular members is slightly greater than half the distance between adjacent support members. This avoids interference between ends of adjacent tube members which might otherwise lock against each other during operation. However, the exact length ratio is not critical and a wide range of length ratios can be used, including tube lengths which are less than half the distance between adjacent support members. The mass of the tubular member can be adjusted by change in material or inside and outside diameter, if desired, to compensate for changes in tube length, while still maintaining the desired dampening function.

While the form of the invention shown and described herein is admirably adapted to fulfill the objects primarily stated, it is to be understood that it is not intended to confine the invention to the form or embodiment disclosed herein, for it is susceptible of embodiment in various other forms within the scope of the appended claims.

What is claimed is:

1. A printing mechanism comprising:

frame means including at least two support members;

at least one elongated printing element extending through and supported by said support members and capable of being driven in an axial direction to effect printing;

driving means operatively connected to said printing element for axially driving said element; and at least one tubular element having a length less than the distance between adjacent support members, and being unattached to said support members and riding freely on said printing element to dampen undesired transverse movement and vibration thereof.

2. The printing mechanism of claim 1, including a plurality of elongated printing elements supported by the support members of said frame means, and at least one tubular element on each printing element.

3. The printing mechanism of claim 1 in which the length of the tubular element is slightly greater than one half the distance between adjacent support members, between which the tubular element is positioned on the printing element.

4. The printing mechanism of claim 1 in which the mass of the elongated printing element between adjacent support members is approximately one seventeenth of the mass of the tubular element positioned thereon between said support members.

5. The printing mechanism of claim 1 in which the tubular element is of annular cross-sectional configuration.

6. The wire printing mechanism of claim 1 in which the frame means includes at least three support members and in which said tubular elements are positioned on said elongated printing element between the first and second support members and between the second and third support members.

7. The printing mechanism of claim 1 in which said tubular element is flexible and has a low coefficient of friction.

8. The printing mechanism of claim 1 in which said tubular element is made of polytetrafluoroethylene resin.

9. The printing mechanism of claim 1 in which said tubular element is made of fluorocarbon resin.

10. A printing mechanism comprising:

frame means including at least first, second and third support members;

a plurality of elongated printing elements extending through and supported by said support members;

driving means associated with each printing element for driving it axially in a printing operation;

a first tubular element riding freely on each printing element between said first and second support members; and a second tubular element riding freely on each printing element between said second and third support members, said first and second tubular elements being unattached to said support members.

11. An impact printing mechanism comprising: frame means;

at least one elongated printing element extending through said frame means and actuable in a predetermined path of travel to effect a printing operation on recording media;

actuating means for effecting traverse of said printing element along said path of travel; and a tubular-like element unattached to said frame means, capable of axial movement, and free riding on said printing element to prevent any undesired transverse movement thereof.

* * * * *